US005538252A

United States Patent [19]

Green

[11] Patent Number: 5,538,252

[45] Date of Patent: Jul. 23, 1996

[54] METHOD OF PLAYING A CARD GAME

[76] Inventor: John R. Green, 8006 S. Wheeling, #F, Tulsa, Okla. 74136

[21] Appl. No.: 380,041

[22] Filed: Jan. 30, 1995

[51] Int. Cl.[6] ..... A63F 1/00

[52] U.S. Cl. ..... 273/306; 273/292; 273/274

[58] Field of Search ..... 273/292, 306, 273/309, 274, 85 CP

[56] References Cited

U.S. PATENT DOCUMENTS

| | | | |
|---|---|---|---|
| 95,160 | 9/1869 | Stevens | 273/306 |
| 1,117,316 | 11/1914 | Booton | 273/306 |
| 1,361,202 | 12/1920 | Thomas | 273/306 |
| 1,703,754 | 2/1929 | Smedley | 273/306 |
| 4,170,358 | 10/1979 | Hancock | 273/304 |
| 4,222,572 | 9/1980 | Baker | 273/306 |
| 4,588,193 | 5/1986 | Winston | 273/304 |
| 4,861,041 | 8/1989 | Jones et al. | 273/292 |
| 5,013,049 | 5/1991 | Tomaszewski | 273/292 |
| 5,072,946 | 12/1991 | Miller | 273/292 |
| 5,098,107 | 3/1992 | Boylan et al. | 273/292 |
| 5,288,077 | 2/1994 | Jones | 273/292 |
| 5,320,356 | 6/1994 | Cauda | 273/292 |
| 5,413,351 | 5/1995 | Franklin | 273/274 |

OTHER PUBLICATIONS

The Fresno Bee, "Blackjack introduced at Table Mountain" by Royal Calkins, Tuesday Nov. 10, 1992.

Scarne's Encyclopedia of Card Games, pp. 290–291.

*Primary Examiner*—Benjamin H. Layno

*Attorney, Agent, or Firm*—John Edward Roethel

[57] ABSTRACT

A Twenty-One game is modified by adding one or more Jokers to a standard deck of fifty-two playing cards. In one version, each Joker dealt as one of the first two cards is counted as a variable number so that the resulting first two cards are then valued at a numerical count of an ordinary twenty-one. In this version, any Jokers appearing after the first two cards have a numerical value of one. In a second version, if either the player or the dealer's first two cards are a Joker-Joker combination or a Joker-Ace combination, the hand automatically becomes a Blackjack. In any other first two card combinations, the Joker is a non-playable card and must be replaced with a playable card. After the player and the dealer each have two playable cards, their respective hands are then played out. If, during the play of the hands and before the player and the dealer either stand or bust, a Joker is dealt, the Joker has a numerical value of one. In a third version the method of play follows the conventional manner of play of Twenty-One except when a Joker is dealt to either a player or the dealer. The Joker is given a pre-established value during the first two cards and a pre-established value after the first two cards. A PRESS feature, either progressive or multi-level progressive, or another progressive or multi-level progressive jackpot feature may be included.

29 Claims, 1 Drawing Sheet

METHOD OF PLAYING A CARD GAME

This invention relates to a casino card game, and more particularly to a casino card game which is a variation of Twenty-One utilizing at least one Joker added to a conventional deck of playing cards.

BACKGROUND OF THE INVENTION

Twenty-One (also called Blackjack) is a game of chance between a dealer and one or more players. The object is for the player to achieve a count on his hand of 21 or, at least, closer to 21 than the count of the hand of the dealer; but if the count of the player's hand goes over 21 then the player loses regardless of the final count of the dealer's hand.

The conventional manner of play of Twenty-One is as follows: A standard deck of playing cards is used and each card counts its face value, except Aces which have a value of one or eleven according to house rules for the dealer's hand, or player discretion on the player's hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards (take "hits") in order to try and improve the player's hand. If the player's count exceeds 21, the player "busts." The player may "stand" on any count of 21 or less. When a player busts, he loses his wager regardless of whether or not the dealer busts.

After all of the players have taken hits or have stood on their hand, the dealer "stands" or "hits" based on pre-established rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of 11, instead of as a count of 1. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts, the player wins regardless of the numerical count of his hand. If neither the player nor the dealer have busted, the closest hand to a numerical count of 21, without going over, wins; tie hands are a "push."

There are other procedures that are included in the conventional manner of play of Twenty-One. One well-known procedure is "Doubling Down." If the player's first two cards have a combined value of 10 or 11, the player may "double down" on his hand. The player turns both of his cards face-up in front of him and makes a second wager equal to the amount of his initial ante. The dealer deals to the player one additional card and the resulting three card hand establishes the numerical count for the player's hand. The most widely used "Doubling Down" rules permit the player to "double down" only on 10 or 11 counts. Other variations allow players to "double down" on 9, 10 or 11; only on 11; or on any two cards.

Another well-known procedure is "Splitting Pairs." If the player's first two cards are a pair, the player may "split" those cards into two separate hands. His original ante is applied to one of the hands and he makes an additional ante for the other hand. The player receives a new second card for each of the split hands. Each of the split hands is played separately and the player proceeds by standing or taking hits until he has achieved a hand count upon which he wishes to stand or busts.

The player may "double down" on either or both of his split hands if he is eligible to do so under the "Doubling Down" rules. The player may split again if he pairs up on either or both of his split hands. In most gaming establishments, a player may also split his hand if both of his initial cards are ten count cards (Tens, Jacks, Queens or Kings). For example, a player can split if he receives a Ten and a Queen, or a Jack and a King, or any combination of ten count cards. Because a hand count of 20 is a good hand to have, most experienced Twenty-One players are reluctant to risk such a hand by "splitting".

Another well-known procedure is "Insurance." If the dealer's up card is an Ace, the player may make an additional "insurance" bet. The insurance bet is made after each player receives his first two cards and the dealer reveals his up card and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a two-card 21 count, the player wins two-to-one odds on his "insurance" bet. Also if the dealer has a two-card 21 count, that round of the game is over and all players lose except those who also have two-card 21 counts who tie or "push" with the dealer. If the dealer does not have a two-card 21 count, the player loses on his "insurance" bet and the round of the game continues. Insurance bets are only permitted when the dealer's "up" card is an Ace.

Another well-known variation of Twenty-One is the "Surrender" feature. After the player receives his first two cards and the dealer's "up" card has been shown, the player may surrender. The player folds his hand and loses one-half of his bet.

As used in this disclosure and the accompanying claims, the terms "conventional Twenty-One" and "the conventional manner of play of Twenty-One" mean the game of Twenty-One as previously described and also including any of the known variations of the game of Twenty-One.

There have been a few modifications proposed to the basic game, but none of these modifications have achieved universal popularity. For example, in the conventional Twenty-One game, the dealer shows one (the "up" card) of his first two cards and the other card (the "hole" card) is kept hidden until all the players have drawn to their hands. One modification involves the dealer showing both of his cards face up before the players draw. This improves the player's odds of winning and the payout odds have been modified to adjust for this change so that the house's advantage remains.

Recently a Twenty-One game known as "Royal Match 21" has been introduced. A player makes a separate bet to be eligible for the Royal Match feature of the game. If the player's first two cards are of the same suit, the player is an instant winner and receives whatever the posted payout is. If the player's first two cards are the Ace and King of the same suit, the player wins whatever the posted Royal Match payout is. The separate Royal Match bets are placed in a separate jackpot and the player wins half of the jackpot amount for a Royal Match. The house retains the remainder of the jackpot.

Another recently introduced Twenty-One game is "Fortune Card 21." In this game, extra Fortune Cards of various colors are added to a standard playing deck of cards. Whenever a Fortune Card is dealt, each player has the option of making a separate Fortune Card bet. If the next card dealt is also a Fortune Card, each player who has made a Fortune Card bet is a winner. The amount won depends on the colors of the Fortune Cards. The separate Fortune Card bets are placed in a separate jackpot and the players win potions of the jackpot amount for winning Fortune Card events. One-half of the Fortune Card jackpot is retained by the house.

U.S. Pat. No. 4,861,041 (Jones et al.) discloses a Twenty-One game in which the player may make a separate bet at the beginning of the game in order to be eligible for a separate jackpot. Those players who have made this separate bet can win all of part of the jackpot if the player's cards correspond to certain predetermined hands. For example, if a player achieves four 5's and an Ace, the player can win 100% of the jackpot. If the player achieves an Ace, Two, Three, Four, Five and Six, the player wins 10% of the jackpot. Other combinations can pay other percentages or flat amounts from the jackpot. The amount of this side jackpot continues to progress until all or part of the jackpot is won by a player.

U.S. Pat. No. 5,174,579 to Griffith discloses a modification to Twenty-One in which the player makes a separate bet as to whether the dealer will bust on his hand. This gives the player two chances to win on each deal of the cards—once on his hand and once if the dealer busts. The outcome of the player's own hand has no affect on the second bet involving whether the dealer busts on his hand.

It is an object of the present invention to provide a form of Twenty-One in which more play options are provided so that additional winning combinations are introduced into the play of the game.

It is a feature of the present invention to provide a standard deck of playing cards with one or more Jokers that can be used in a variety of different ways during the play of Twenty-One.

It is an advantage of the present invention that the number of options of the game of Twenty-One has been increased, there are more winning combinations and more excitement and unpredictability have been introduced into the game.

Other objects, features and advantages of the present invention will become apparent from a consideration of the following detailed description.

SUMMARY OF THE INVENTION

The present invention is a modification to the process of conventional play of Twenty-One wherein one or more Jokers (or other non-standard cards acting the same as a Joker) are added to the standard deck of fifty-two playing cards. The invention allows many enhancements to the conventional play of Twenty-One resulting in new playing versions of conventional Twenty-One.

In one version of the present invention (which is the most preferred embodiment of the invention), each Joker dealt as one of the first two cards is counted as a variable number so that the resulting first two cards is then valued at a numerical count of an ordinary twenty-one. In this version, any Jokers appearing after the first two cards (during the "hit" portion of the method of play) are counted as a having a numerical value of one.

In a second version of the present invention, if either the player or the dealer is dealt a Joker-Joker combination or a Joker-Ace combination as the first two cards, the hand automatically becomes a Blackjack. In any other first two cards combination, the Joker is a non-playable card and must be replaced by a playable card. After the player and the dealer each have two playable cards, their respective hands are then played out. If, during the play out of the hands and before the player and the dealer either stand or bust, a Joker is dealt, the Joker has a numerical value of one.

In a third version of the present invention, one Joker is added to a deck of conventional fifty-two playing cards. The method of play follows the conventional manner of play of Twenty-One except as modified when a Joker is dealt to either a player or the dealer during the play of the hand. The Joker is given a pre-established value during the first two cards and a pre-established value after the first two cards and when a Joker appears during the play of the game, the pre-established value for the Joker then becomes operative.

A PRESS feature, a PRESS progressive or multi-level progressive jackpot feature or another progressive jackpot feature may also be included.

DETAILED DESCRIPTION OF THE PREFERRED EMBODIMENTS

Figure 1:
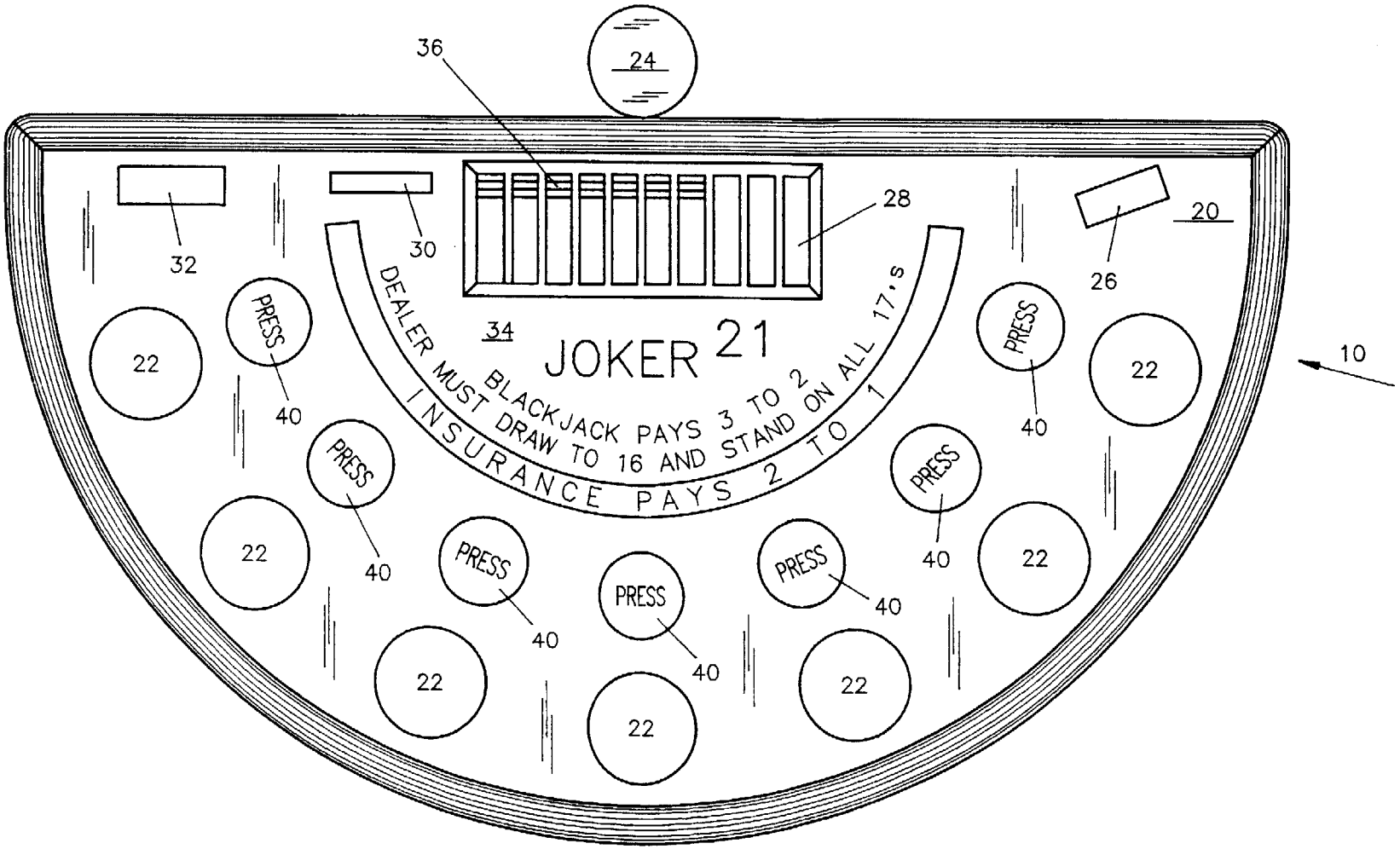
FIG. 1 shows a gaming table layout upon which the method of the present invention can be practiced.

The method of the present invention can be practiced on a conventional gaming table 10 using a table layout shown generally at 20 in FIG. 1. The table layout 10 includes a plurality of player betting locations 22 arranged around the outer periphery of the table. The dealer as is conventional stands at dealer location 24. From the dealer location 24, the dealer has access to the dealing shoe 26 which contains the playing cards used in the method of play. Alternatively, a conventional automatic card shuffling machine can be used. The dealer also has access to the chip rack 28, PRESS chips 36 and the money slot 30. A table range marker is provided at 32 to advise the players of the wagering limits in effect at the gaming table 10. In the center 34 of the table, certain game information and the name of the game is imprinted on the table layout 20 as is also conventional. Adjacent each player betting location 22, there is provided a second betting location 40 which is used for the optional PRESS feature of the method of the present invention as will be explained below.

The method of the present invention is a modification to the Conventional Manner of Play of Twenty-One.

Version #1

In Version #1 of the method of the present invention, a standard fifty-two card deck of playing cards is modified by the addition of one Joker to the deck. The method of play follows the Conventional Manner of Play of Twenty-One except as modified when a Joker is dealt to either a player or the dealer during the play of a hand.

At the beginning of the hand, two cards are dealt to the player and two cards to the dealer according to the standard dealing procedures in force at the particular gaming establishment. If a player or the dealer receives a Joker as one of his two cards, the Joker is valued at whatever numerical value is necessary so that the two cards have a numerical value of an ordinary twenty-one (i.e. the hand is not treated as a Blackjack which is paid at three-to-two odds in the conventional manner of play of Twenty-One; but rather is treated as simply a hand having a numerical count of twenty-one). For example, if the player receives a six of hearts and a Joker, the Joker in the player's hand is valued at fifteen so that the resulting two-card player hand has a numerical value of twenty-one. Similarly, if the dealer receives a ten of clubs and a Joker, the Joker in the dealer's hand is valued at eleven so that the resulting two-card dealer hand has a value of twenty-one.

If the game is being dealt using multiple decks of cards each having one Joker added thereto (such as using a six deck shoe of playing cards to deal the game), it is possible for either the player or the dealer to receive two Jokers as the first two cards dealt. In this instance, a two Joker hand (received as the first two cards) is treated as a Joker$^{21}$ blackjack, which is treated as a traditional Blackjack so that the player receives an additional payout (in the preferred embodiment, this payout would be at three-to-two odds) or the dealer's hand is considered to beat all other hands at the table except those players having a Blackjack. For example, if the dealer receives two Jokers as the dealer's first two cards, the dealer's Joker$^{21}$ blackjack hand beats all other hands (including hands holding a Joker and any other card since those hands have a numerical value of an ordinary twenty-one) except those hands having a Blackjack or another Joker$^{21}$ blackjack.

If neither the player or the dealer receives a Joker in the first two cards dealt, the game continues according to the conventional manner of play of Twenty-One. Players may double down, split pairs (although players should not split Jokers because two Jokers equal a Joker$^{21}$ blackjack, the most powerful hand; but if a player splits two Jokers, then each Joker has the value of one and can receive additional cards), take insurance (except that insurance is not available against a dealer showing a Joker as his up card), surrender (except that surrender is not available when the dealer's up card is a Joker) or otherwise engage in the conventional manner of play of Twenty-One as permitted by the particular house rules if effect at the gaming establishment.

If a Joker is dealt to either a player or a dealer after the first two cards are dealt (i.e., during the "hitting" portion of the conventional manner of play of Twenty-One), the Joker is treated as having a numerical value of one.

Table 1 sets out various combinations that can occur when a Joker appears in either the player's hand or the dealer's hand as part of the initial two cards being dealt.

TABLE 1

| | HAND *(first column is dealer's up card | | SCORE | RESULTS | BET | PLAYER | HOUSE |
|---|---|---|---|---|---|---|---|
| House | K A | | 21 | -Blackjack | | | 10 |
| Player | 4 Joker | | 21 | Player Loses | 10 | −10 | |
| House | 3 Joker | | 21 | | | | |
| Player | Q J | | 20 | Player Loses | 10 | −10 | 10 |
| House | Joker 8 | | 21 | | | | |
| Player | K 9 6 | | Bust | Player Loses | 10 | −10 | 10 |
| Player | A 10 | | 21 | Player Wins--Blackjack | 10 | 15 | −15 |
| House | A Q | | 21 | -Blackjack | | | |
| Player | Joker K | Insurance | 21 | Player Loses | 10 | −10 | 10 |
| | | | | Player Wins--Insurance | 5 | 10 | −10 |
| House | Joker A | | 21 | | | | |
| Player | 10 Joker | | 21 | Player Ties | 10 | — | — |
| House | A Joker | | 21 | | | | |
| Player | Joker Joker | No Ins. | 21 | Player Wins- | 10 | 15 | −15 |
| Player | K Joker | No Ins. | 21 | Joker$^{21}$ BJ Player Ties | 10 | — | — |
| House | AK | | 21 | -Blackjack | | | |
| Player | Joker Joker | No Ins. | 21 | Player Ties-- | 10 | — | — |
| | Joker Joker | Even Money | 21 | Joker$^{21}$ BJ | 10 | 10 | −10 |
| | Joker Joker | Insurance | 21 | Player Ties-- | 10 | — | — |
| | | | | Joker$^{21}$ BJ | 5 | 10 | −10 |
| | | | | Player Ties--Joker$^{21}$ BJ Player Wins--Insurance | | | |
| House | Joker Joker | | 21 | JOKER$^{21}$ BJ | | | |
| Player | 4 9 | | 13 | Player Loses | 10 | −10 | 10 |
| House | K 4 4 | | 18 | | | | |
| Player | 6 6 (Split) 6 Joker 9 5 | | 21 | Player Wins | 10 | 10 | −10 |
| | 6 4 5 | | 15 | Player Loses | 10 | −10 | 10 |
| House | 5 10 5 | | 20 | | | | |
| Player | 5 3 (DD) Joker | | 9 | Player Loses | 10 | −20 | 20 |

As shown in Table 1, two Jokers are dealt to either a player or a dealer, the hand receiving the two Jokers automatically becomes a Joker$^{21}$ blackjack and is treated and paid just like a conventional blackjack. Similarly, if during the initial two card deal, the dealer receives a Joker as his "up" card and the dealer does not have two Jokers, the players who do not have either a Joker$^{21}$ blackjack or a conventional blackjack should proceed with the play of their hands according to the conventional manner of play of Twenty-One bearing in mind that the dealer's two cards are automatically valued at a numerical count of twenty-one.

In this Version #1 of the present invention, some of the combinations set out in Table 1 will only be possible if more than one deck of playing cards are used, each having one Joker added to the standard deck of playing cards.

In the preferred embodiment of the present invention, one Joker is added for each standard fifty-two card deck of playing cards that are included in the dealing shoe. For example, if a four deck dealing shoe is being used, four Jokers will be included. Likewise, if a six deck dealing shoe is being used, then six Jokers are being included. In these situations, it is theoretically possible for both a player and a dealer to receive two Jokers as the initial two cards dealt to each.

Version #2

In Version #2 of the method of the present invention, a standard fifty-two card deck of playing cards is modified by the addition of one Joker to the deck. The method of play follows the Conventional Manner of Play of Twenty-One except as modified when a Joker is dealt to either a player or the dealer during the play of a hand.

In this Version #2 of the present invention, Jokers have significance during the initial deal of the two cards to the player and the dealer. If a player or the dealer receives either a Joker-Joker combination or a Joker-Ace combination, the hand automatically becomes a blackjack. After all cards have been dealt for the initial two card hands, the dealer determines if any players or the dealer have either a Joker-Joker combination or a Joker-Ace combination. If not, any player or the dealer show any Jokers they may be holding and the Joker is replaced in the hand by a new card that is not a Joker. Then the play of the game proceeds according to the conventional manner of play of Twenty-One. If during this continuation of play a player or the dealer receives a Joker, the Joker is treated as having a value of one.

Table 2 sets out various combinations that can occur when a Joker appears in either the player's hand or the dealer's hand as part of the initial two cards being dealt.

In this Version #2 of the present invention, some of the combinations set out in Table 2 will only be possible if more than one deck of playing cards are used, each having one Joker added to the standard deck of playing cards.

In the preferred embodiment of the present invention, one Joker is added for each standard fifty-two card deck of playing cards that are included in the dealing shoe. For example, if a four deck dealing shoe is being used, four Jokers will be included. Likewise, if a six deck dealing shoe is being used, then six Jokers are being included. In these situations, it is theoretically possible for both a player and a dealer to receive two Jokers as the initial two cards dealt to each.

Version #3

In Version #3 of the present invention, one Joker is added to a deck of conventional fifty-two playing cards. The method of play follows the conventional manner of play of Twenty-One except as modified when a Joker is dealt to either a player or the dealer during the play of the hand. The Joker is given a pre-established value during the first two cards and a pre-established value after the first two cards and when a Joker appears during the play of the game, the pre-established value for the Joker then becomes operative.

EXAMPLE #A

Joker has Pre-established Value of Blackjack:

In this example, if a Joker appears during the first two cards or after the first two cards, the hand is automatically valued (or revalued) to the status of a Blackjack. This applies to both a player's hand and the dealer's hand.

EXAMPLE #B

Joker has Pre-established Value of Complementary to Twenty-one:

In this example, if a Joker appears during the first two cards or after the first two cards, the hand is automatically valued (or revalued) to the status of an ordinary twenty-one

TABLE 2

| | FIRST TWO* | REPLACE | | ADDITIONAL | | | SCORE | RESULTS | BET | PLAYER | HOUSE |
|---|---|---|---|---|---|---|---|---|---|---|---|
| House | K A | — | — | — | — | — | 21 | -Blackjack | | | |
| Player | 10 Jok | A | — | — | — | — | 21 | Player Ties -Blackjack | 10 | — | — |
| House | 4 10 | — | — | 3 | — | — | 17 | | | | |
| Player | 2 Jok | 4 | — | 10 | 2 | — | 18 | Player Wins | 10 | 10 | −10 |
| House | Jok | — | — | — | — | — | 21 | -Joker[21]BJ | | | |
| Player | Jok | — | — | — | — | — | 20 | Player Loses | 10 | −10 | 10 |
| | 10 Q | | | | | | | | | | |
| House | A Jok | — | — | — | — | — | 21 | -Blackjack | | | |
| Player | 4 4 | No Ins. | | — | — | — | 8 | Player Loses | 10 | −10 | 10 |
| House | 3 7 | — | — | A | — | — | 21 | | | | |
| Player | K Jok | Jok A | | — | — | — | 21 | Play Wins-Blackjack | 10 | 15 | −15 |
| House | 8 7 | — | — | 4 | — | — | 19 | | | | |
| Player | 8 Jok | 8 | — | Split | | | | | | | |
| | | | | | | Jok | 19 | Player Ties | 10 | — | — |
| | | | | 10 | | | 19 | Player Ties | 10 | — | — |
| | | | | | 5 | 6 | | | | | |
| House | K Q | — | — | — | — | — | 20 | | | | |
| Player | 4 6 | — | — | | DD | Jok | 11 | Player Loses | 10 | −20 | 20 |
| House | 8 4 | — | — | 10 | — | — | | | | | |
| Player | 5 Jok | 5 | — | DD | 3 | — | Bust | Player Wins | 10 | 20 | −20 |
| | | | | | | | 13 | | | | |
| House | A Jok | — | — | — | — | — | 21 | -Blackjack | | | |
| Player | 4 Q | Insur. | | — | — | — | 14 | Player Loses | 10 | −10 | 10 |
| | | | | | | | | Player Wins-Insurance | 5 | 10 | −10 |

hand count. This applies to both a player's hand and the dealer's hand.

EXAMPLE #C

Joker has Pre-established Value of Complementary to Twenty-one During First Two Cards; After First Two Cards, Joker has a Numerical Value of Zero:

In this example, if a Joker appears during the first two cards, the hand is automatically valued to the status of an ordinary twenty-one hand count. If a Joker is dealt after the first two cards, the Joker is counted in the hand as having a value of zero. This applies to both a player's hand and the dealer's hand.

EXAMPLE #D

Joker has Pre-established Value of Complementary to Twenty-one During First Two Cards, After First Two Cards, Joker has a Numerical Value of Ten:

In this example, if a Joker appears during the first two cards, the hand is automatically valued to the status of an ordinary twenty-one hand count. If a Joker is dealt after the first two cards, the Joker is counted in the hand as having a value of ten. This applies to both a player's hand and the dealer's hand.

EXAMPLE #E

Joker has Pre-established Value of Complementary to Twenty-one During First Two Cards; After First Two Cards, Joker has a Numerical Value of Ace (One or Eleven):

In this example, if a Joker appears during the first two cards, the hand is automatically valued to the status of an ordinary twenty-one hand count. If a Joker is dealt after the first two cards, the Joker is counted in the hand as having a value of an Ace (one or eleven). This applies to both a player's hand and the dealer's hand.

Table 3 shows this Version #3 of the present invention with representative hands that can occur during play. Jokers received anytime before standing or busting can be used to automatically convert the hand to any specified outcome:

TABLE 3

| Joker 1st Two Cards | Example #A Joker = Blackjack | Example #B Joker = ordinary twenty-one | Example #C Joker = zero, after 1st two cards | Example #D Joker = ten, after 1st two cards | Example #E Joker = Ace, after 1st two cards |
|---|---|---|---|---|---|
| Joker 6 | Blackjack | 21 | 21 | 21 | 21 |
| Q Joke | Blackjack | 21 | 21 | 21 | 21 |
| Joker Joker | Joker[21] Blackjack | Joker[21] Blackjack | Joker[21] Blackjack | Joker[21] Blackjack | Joker[21] Blackjack |
| Joker After 1st Two Cards | | | | | |
| 4 8 Joker | Blackjack | 21 | 12 | Bust | 13 |
| 4 8 2 Joker | Blackjack | 21 | 14 | Bust | 15 |
| 4 8 2 A Joker | Blackjack | 21 | 15 | Bust | 16 |
| 4 8 2 Joker | Blackjack | 21 | 19 | Bust | 21 |
| Joker 5 | | | | | |
| 88 (Split) | | | | | |
| 8 Joker | Blackjack | 21 | 8 | 18 | 19 |
| 8 6 Joker | Blackjack | 21 | 14 | Bust | 15 |
| 4 7 (DD) | Blackjack | 21 | 11 | 21 | 12 |
| Joker | | | | | |

With regard to each version of the present invention, instead of using one Joker for each standard fifty-two card deck of cards, a greater or lesser number of Jokers can be used. For example, six decks could have seven, five, four, etc. Jokers. In multiple deck versions of the method of the present invention, it is possible for both the player and the dealer to receive two Jokers as the initial two cards dealt to each. In such a situation, the hand receiving the two Jokers automatically becomes a Joker[21] blackjack and is treated and paid just like a conventional Blackjack.

A PRESS feature, a PRESS progressive or multi-level progressive jackpot feature, or another progressive or multi-level progressive jackpot feature may be added to these versions of the present invention.

A side bet or an additional wager that can be added to the method of the present invention is a side bet called PRESS. In PRESS, each player makes a second wager at location 40 shown on the table layout 20 in FIG. 1, to be eligible to win the PRESS feature; PRESS allowable bet amounts will be posted at each gaming table. The PRESS feature is, in effect, a separate game, but is based on the outcome of the first player's position hand in the regular game.

At a suitable location on the gaming table layout, preferably in a designated portion of the chip rack 28, the dealer will have groups of PRESS chips or tokens, one group allocated for each player at the gaming table. Each PRESS chip within the group will be assigned an incremental payout, and, if desired, incrementally numbered. Alternatively, each PRESS chip may just be incrementally numbered, with the chip number associated to a payout schedule supplied at the table.

Each time a player wins his first player's position hand in the regular game, the dealer will take the first PRESS chip from that player's group and place the PRESS chip on top of the PRESS bet that has been made by the player. As long as the player continues to win his first player position consecutive hands in the regular game, his PRESS chip count will continue to increase. Once the player achieves a desired number of consecutive wins, the player may then stop his PRESS bet and receive the designated payout amount times the amount of his PRESS bet. The player may also let his PRESS bet continue in hopes of winning more consecutive hands and receive higher payouts, up to the limit of the game set by the gaming establishment. Any time the player loses a hand, his PRESS bet is lost to the house and he must start over in attempting to achieve consecutive winning hands. If the player's regular first position hand is a tie, the press bet is treated as a push. If the player's regular first position hand is surrendered, the press bet is lost.

In the preferred embodiment, the highest consecutive winning hands wins the highest payout. If a player decides to stop playing the game, he must advise the dealer prior to the beginning of the next hand. The dealer will return to the player the amount of his PRESS bet along with the designated chip payout times the PRESS bet.

The dealer needs different groups of PRESS chips for each player since each player may be on a different sequence of consecutive winning hands. Any number of PRESS chips can be used and the associated payouts can be set at any size or amount. Optionally, PRESS chips carrying the payouts can be any number of the chips selected from the entire group of PRESS chips.

The PRESS feature may also be played as a progressive jackpot, or optionally as a multi-level progressive jackpot, with the player achieving a desired payable chip or the highest payable chip, as posted by the gaming establishment at the table, receiving all or a portion of the jackpot amount.

The PRESS progressive jackpot is preferably played with a player bet of one dollar ($1). Optionally, the PRESS multi-level progressive jackpot is preferably played with a player bet of either one dollar ($1) or two dollars ($2). For a two dollar bet, the players winnings are doubled. The PRESS multi-level progressive jackpot has a reserve amount equal to the progressive jackpot amount for payouts in excess of one dollar. If playing the PRESS progressive jackpot, revenues from the player bets are preferably allocated fifty percent to the gaming establishment and fifty percent to the progressive jackpot. If playing the PRESS multi-level progressive jackpot, revenues from player bets are preferably allocated fifty per cent to the gaming establishment, twenty-five per cent to the progressive jackpot and twenty-five per cent to the reserve account. The reserve account will always equal the progressive jackpot amount during the seed, allocation of revenues and after payouts. If a payout is made from the progressive jackpot, but not proportionately from the reserve account, the reserve will be reduced to equal the progressive jackpot, with the reduction amount being transferred to the gaming establishment. The gaming establishment will decide to either use the PRESS progressive jackpot or the PRESS multi-level progressive jackpot at their gaming tables.

At a suitable location on the gaming table layout, preferably in a designated portion of the chip rack 28, the dealer will have groups of PRESS chips or tokens, one group for each player at the gaming table. Each PRESS chip within the group will be incrementally numerically numbered and certain assigned chips will be labeled with an incremental payout (a payable chip) and the remaining chips labeled with the word PRESS (a non-payable chip).

Each time a player wins his first player's position hand in the regular game, the dealer will take the first PRESS chip from that player's group and place the PRESS chip on top of the PRESS bet that has been made by the player; PRESS allowable bet amounts will be posted at each table. As long as the player continues to win first player position consecutive hands in the regular game, his PRESS chip count will continue to increase. Once the player reaches a payable chip, the player may then stop his PRESS bet and receive the designated payout amount times his PRESS bet. The player may also let his PRESS bet continue in hopes of reaching the next payable chip up to the highest payable chip set by the gaming establishment. Any time the player loses a hand, his PRESS bet is lost to the house and he must start over in attempting to achieve consecutive winning hands to reach a payable chip. If the player's regular first position hand is a tie, the press bet is treated as a push. If the player's regular first position hand is surrendered, the press bet is lost.

In this preferred embodiment, the highest payable chip wins the PRESS progressive jackpot or the PRESS multi-level progressive jackpot. If a player decides to stop playing the game, he should stop on a payable chip and then advise the dealer of his intention to stop prior to the beginning of the next hand. The dealer will return to the player the amount of his PRESS bet along with the designated chip payout times the PRESS bet if the payable chip is on top; only the PRESS bet is returned if a non-payable chip is on top.

The dealer needs different groups of PRESS chips for each player since each player may be on a different sequence of consecutive winning hands. Any number of PRESS chips can be used and the associated payouts can be set at any size or amount. Optionally, PRESS chips carrying the payouts can be any number of the chips selected from the entire group of PRESS chips.

In this embodiment, a separate money drop should be used to keep track of the PRESS wagers that are made and display monitors can be centrally located showing the amount of the PRESS progressive jackpot or the PRESS multi-level progressive jackpot. Additionally, PRESS bets can be played with conventional Twenty-One and with other similar games tied to winning a consecutive number of hands.

As an alternative to PRESS bet wagering, the method of the present invention can also be used with a progressive jackpot, or optionally with a multi-level progressive jackpot, based on preselected Joker[21] winning hand combinations posted at the gaming establishment. The progressive jackpot is preferably played with a player bet of one dollar ($1). Optionally, the multi-level progressive jackpot is preferably played with a player bet of either one dollar ($1) or two dollars ($2). For a two dollar bet, the players winnings are doubled. The multi-level progressive jackpot has a reserve amount equal to the progressive jackpot amount for payouts in excess of one dollar. If playing the progressive jackpot, revenues from the player bets are preferably allocated fifty percent to the gaming establishment and fifty percent to the progressive jackpot. If playing the multi-level progressive jackpot, revenues from player bets are preferably allocated fifty per cent to the gaming establishment, twenty-five per cent to the progressive jackpot and twenty-five per cent to the reserve account. The reserve account will always equal the progressive jackpot amount during the seed, allocation of revenues and after payouts. If a payout is made from the progressive jackpot, but not proportionately from the reserve account, the reserve will be reduced to equal the progressive jackpot, with the reduction amount being transferred to the gaming establishment.

In order to be eligible for the progressive jackpot or the multi-level progressive jackpot, at the beginning of each round of play a player makes a second wager in a jackpot wager location on the table layout. Preferably, the PRESS bet location would be used with the table layout modified to identify this location as the jackpot wager location. A player will win or share in the progressive jackpot or the multi-level progressive jackpot if the first two, three or four cards dealt to the player are one of the preselected Joker[21] winning hand combinations posted at the gaming establishment. For example, a preselected winning hand combination could be a Joker paired with other cards, a pair of Jokers, a numbered Joker paired with other cards, a pair of numbered Jokers or various preselected Jokerless combinations. In multiple deck versions of the present invention having multiple Jokers, each of the Jokers can be numbered in order to distinguish them, one from another. In order to track the amount of money wagered on the progressive jackpot or the multi-level progressive jackpot feature of the method of the present invention, a separate money drop area can be used. A display meter or monitor can be used to show the amount registered on the progressive jackpot or the multi-level progressive jackpot. As an option to the gaming establishment, there may be one winning combination or multiple winning combinations active at any one time. The gaming establishment will decide to either use the PRESS progressive jackpot or the PRESS multi-level progressive jackpot at their gaming tables.

Additionally, multi-level progressive jackpot bets can be played with conventional Twenty-One and with all other jackpot games.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a modified version of Twenty-One wherein a standard fifty-two card deck of playing cards is modified by the addition of one or more Jokers comprising:

a) a player making a wager to be eligible to receive a hand of cards;

b) a dealer dealing two cards to the player comprising a player's hand and two cards to the dealer comprising a dealer's hand;

c) if the player's hand or the dealer's hand includes one or more Jokers, the value of the player's hand or the dealer's hand is determined by the following table:

| | HAND * (first column is dealer's up card) | | SCORE | RESULTS | BET | PLAYER | HOUSE |
|---|---|---|---|---|---|---|---|
| House | K A | | 21 | -Blackjack | | | 10 |
| Player | 4 Joker | | 21 | Player Loses | 10 | −10 | |
| House | 3 Joker | | 21 | | | | |
| Player | Q J | | 20 | Player Loses | 10 | −10 | 10 |
| House | Joker 8 | | 21 | | | | |
| Player | K 9 | | Bust | Player Loses | 10 | −10 | 10 |
| Player | A 10 | | 21 | Player Wins--Blackjack | 10 | 15 | −15 |
| House | A Q | | 21 | -Blackjack | | | |
| Player | Joker K | Insurance | 21 | Player Loses | 10 | −10 | 10 |
| | | | | Player Wins-Insurance | 5 | 10 | −10 |
| House | Joker A | | 21 | | | | |
| Player | 10 Joker | | 21 | Player Ties | 10 | — | — |
| House | A Joker | | 21 | | | | |
| Player | Joker Joker | No Ins. | 21 | Player Wins- | 10 | 15 | −15 |
| Player | K Joker | No Ins. | 21 | Joker$^{21}$ BJ Player Ties | 10 | — | — |
| House | AK | | 21 | -Blackjack | | | |
| Player | Joker Joker | No Ins. | 21 | Player Ties-- | 10 | — | — |
| | Joker Joker | Even Money | 21 | Joker$^{21}$ BJ | 10 | 10 | −10 |
| | Joker Joker | Insurance | 21 | Player Ties- | 10 | — | — |
| | | | 21 | Joker$^{21}$ BJ Player Ties-Joker$^{21}$ BJ Player Wins--Insurance | 5 | 10 | −10 |
| House | Joker Joker | | 21 | JOKER$^{21}$ BJ | | | |
| Player | 4 9 | | 13 | Player Loses | 10 | −10 | 10 |
| House | K 4 4 | | 18 | | | | |
| Player | 6 6 (Split) 6 Joker 9 5 | | 21 | Player Wins | 10 | 10 | −10 |
| | 6 4 5 | | 15 | Player Loses | 10 | −10 | 10 |
| House | 5 10 5 | | 20 | | | | |
| Player | 1 5 3 (DD) Joker | | 9 | Player Loses | 10 | −20 | 20 |

d) if neither the player's hand nor the dealer's hand includes a Joker, continuing the play according to the conventional manner of play of Twenty-One with any Jokers dealt having a numerical value of one;

e) the player standing or receiving additional cards from the dealer as the player desires in accordance with the conventional manner of play of Twenty-One;

f) the dealer standing or receiving additional cards in accordance with the conventional manner of play of Twenty-One;

g) comparing the dealer's hand to the player's hand in accordance with the conventional manner of play of Twenty-One; and h) paying the player based on the amount of the player's wager if the player's hand beats the dealer's hand in accordance with the conventional manner of play of Twenty-One.

2. The method of claim 1 in which multiple decks of playing cards are used and one Joker is provided for each deck of playing cards.

3. The method of claim 1 in which multiple decks of playing cards are used and at least one Joker is provided.

4. The method of claim 1 further including:

a) a player making a second wager to be eligible for a separate payout;

b) tracking the number of consecutive hands that a player has won;

c) paying the player a predetermined amount if the player wins a pre-established number of hands in a row.

5. The method of claim 4 in which the predetermined amount is a multiple of the amount of the player's second wager.

6. The method of claim 4 in which the predetermined amount increases as the pre-established number of hands in a row increases.

7. The method of claim 1 further including:

a) a player making a second wager to be eligible for a separate payout;

b) allocating a portion of the second wager to a progressive jackpot;

c) establishing a designated arrangement of cards as a winning combination;

d) paying the player a predetermined amount from the progressive jackpot if the player achieves the designated arrangement of cards.

8. The method of claim 7 in which the predetermined amount is a multiple of the amount of the player's second wager.

9. The method of claim 7 in which the designated arrangement of cards includes at least one joker.

10. A method of playing a modified version of Twenty-One wherein a standard fifty-two card deck of playing cards is modified by the addition of one or more Jokers comprising:

a) a player making a wager to be eligible to receive a hand of cards;

b) a dealer dealing two cards to the player comprising a player's hand and two cards to the dealer comprising a dealer's hand;

c) if the player's hand or the dealer's hand includes one or more Jokers, the value of the player's hand or the dealer's hand is determined by the following table:

| | FIRST TWO* | REPLACE | ADDITIONAL | | | SCORE | RESULTS | BET | PLAYER | HOUSE |
|---|---|---|---|---|---|---|---|---|---|---|
| House | K A | — — | — | — | — | 21 | -Blackjack | | | |
| Player | 10 Jok | A — | — | — | — | 21 | Player Ties -Blackjack | 10 | — | — |
| House | 4 10 | — — | 3 | — | — | 17 | | | | |
| Player | 2 Jok | 4 — | 10 | 2 | — | 18 | Player Wins | 10 | 10 | -10 |
| House | Jok | — — | — | — | — | 21 | -Joker-$^{21}$BJ | | | |
| Player | Jok | — — | — | — | — | 20 | Player Loses | 10 | -10 | 10 |
| | 10 Q | | | | | | | | | |
| House | A Jok | — — | — | — | — | 21 | -Blackjack | | | |
| Player | 4 4 | NoIns. | — | — | — | 8 | Player Loses | 10 | -10 | 10 |
| House | 3 7 | — — | A | — | — | 21 | | | | |
| Player | K Jok | JokA | — | — | — | 21 | Player Wins-Blackjack | 10 | 15 | -15 |
| House | 8 7 | — — | 4 | — | — | 19 | | | | |
| Player | 8 Jok | 8 — | Split | | | | | | | |
| | | | | | Jok | 19 | Player Ties | 10 | — | — |
| | | | 10 | | | 19 | Player Ties | 10 | — | — |
| | | | | 5 | 6 | | | | | |
| House | K Q | — — | — | — | — | 20 | | | | |
| Player | 4 6 | — — | | DD | Jok | 11 | Player Loses | 10 | -20 | 20 |
| House | 8 4 | — — | 10 | — | — | | | | | |
| Player | 5 Jok | 5 — | DD | 3 | — | Bust | Player Wins | 10 | 20 | -20 |
| | | | | | | 13 | | | | |
| House | A Jok | — — | — | — | — | 21 | -Blackjack | | | |
| Player | 4 Q | Insur. | — | — | — | 14 | Player Loses | 10 | -10 | 10 |
| | | | | | | | Player Wins-Insurance | 5 | 10 | -10 |

d) if neither the player's hand nor the dealer's hand includes a Joker, continuing the play according to the conventional manner of play of Twenty-One with any Jokers dealt having a numerical value of one;

e) the player standing or receiving additional cards from the dealer as the player desires in accordance with the conventional manner of play of Twenty-One;

f) the dealer standing or receiving additional cards in accordance with the conventional manner of play of Twenty-One;

g) comparing the dealer's hand to the player's hand in accordance with the conventional manner of play of Twenty-One; and h) paying the player based on the amount of the player's wager if the player's hand beats the dealer's hand in accordance with the conventional manner of play of Twenty-One.

11. The method of claim 10 in which multiple decks of playing cards are used and one Joker is provided for each deck of playing cards.

12. A method of playing a modified version of Twenty-One wherein a standard fifty-two card deck of playing cards is modified by the addition of one or more Jokers comprising:

a) a player making a wager to be eligible to receive a hand of cards, b) a dealer dealing two cards to the player comprising a player's hand and two cards to the dealer comprising a dealer's hand;

c) if the player's hand includes one or more Jokers, the value of the player's hand is determined to be a blackjack;

d) if the dealer's hand includes one or more Jokers, the value of the dealer's hand is determined to be a blackjack;

e) if neither the player's hand nor the dealer's hand includes a Joker, continuing the play according to the conventional manner of play of Twenty-One;

f) if at any time during the play of the hand either the player or the dealer receives a Joker, the value of the hand receiving the Joker is determined to be a blackjack;

g) the player standing or receiving additional cards from the dealer as the player desires in accordance with the conventional manner of play of Twenty-One;

h) the dealer standing or receiving additional cards in accordance with the conventional manner of play of Twenty-One;

i) comparing the dealer's hand to the player's hand in accordance with the conventional manner of play of Twenty-One; and j) paying the player based on the amount of the player's wager if the player's hand beats the dealer's hand in accordance with the conventional manner of play of Twenty-One.

13. The method of claim 12 in which multiple decks of playing cards are used and one Joker is provided for each deck of playing cards.

14. A method of playing a modified version of Twenty-One wherein a standard fifty-two card deck of playing cards is modified by the addition of one or more Jokers comprising:

a) a player making a wager to be eligible to receive a hand of cards;

b) a dealer dealing two cards to the player comprising a player's hand and two cards to the dealer comprising a dealer's hand;

c) if the player's hand includes one Joker, the value of the player's hand is determined to be a numerical count of twenty-one;

d) if the player's hand includes two Jokers, the value of the player's hand is determined to be a blackjack;

e) if the dealer's hand includes one Joker, the value of the dealer's hand is determined to be a numerical count of twenty-one;

f) if the dealer's hand includes two Jokers, the value of the dealer's hand is determined to be a blackjack;

g) if neither the player's hand nor the dealer's hand includes a Joker, continuing the play according to the conventional manner of play of Twenty-One;

h) if at any time during the play of the hand either the player or the dealer receives a Joker, the value of the hand receiving the Joker is determined to be a numerical count of twenty-one;

i) the player standing or receiving additional cards from the dealer as the player desires in accordance with the conventional manner of play of Twenty-One;

j) the dealer standing or receiving additional cards in accordance with the conventional manner of play of Twenty-One;

k) comparing the dealer's hand to the player's hand in accordance with the conventional manner of play of Twenty-One; and l) paying the player based on the amount of the player's wager if the player's hand beats the dealer's hand in accordance with the conventional manner of play of Twenty-One.

15. The method of claim 14 in which multiple decks of playing cards are used and one Joker is provided for each deck of playing cards.

16. A method of playing a modified version of Twenty-One wherein a standard fifty-two card deck of playing cards is modified by the addition of one or more Jokers comprising:

a) a player making a wager to be eligible to receive a hand of cards;

b) a dealer dealing two cards to the player comprising a player's hand and two cards to the dealer comprising a dealer's hand;

c) if the player's hand includes one Joker, the value of the player's hand is determined to be a numerical count of twenty-one;

d) if the player's hand includes two Jokers, the value of the player's hand is determined to be a blackjack;

e) if the dealer's hand includes one Joker, the value of the dealer's hand is determined to be a numerical count of twenty-one;

f) if the dealer's hand includes two Jokers, the value of the dealer's hand is determined to be a blackjack;

g) if neither the player's hand nor the dealer's hand includes a Joker, continuing the play according to the conventional manner of play of Twenty-One;

h) if at any time during the play of the hand either the player or the dealer receives a Joker, the Joker is given the numerical value of zero;

i) the player standing or receiving additional cards from the dealer as the player desires in accordance with the conventional manner of play of Twenty-One;

j) the dealer standing or receiving additional cards in accordance with the conventional manner of play of Twenty-One;

k) comparing the dealer's hand to the player's hand in accordance with the conventional manner of play of Twenty-One; and l) paying the player based on the amount of the player's wager if the player's hand beats the dealer's hand in accordance with the conventional manner of play of Twenty-One.

17. The method of claim 16 in which multiple decks of playing cards are used and one Joker is provided for each deck of playing cards.

18. The method of claim 16 in which multiple decks of playing cards are used and at least one Joker is provided.

19. The method of claim 16 further including:

a) a player making a second wager to be eligible for a separate payout;

b) tracking the number of consecutive hands that a player has won;

c) paying the player a predetermined amount if the player wins a pre-established number of hands in a row.

20. The method of claim 19 in which the predetermined amount is a multiple of the amount of the player's second wager.

21. The method of claim 19 in which the predetermined amount increases as the pre-established number of hands in a row increases.

22. A method of playing a modified version of Twenty-One wherein a standard fifty-two card deck of playing cards is modified by the addition of one or more Jokers comprising:

a) a player making a wager to be eligible to receive a hand of cards;

b) a dealer dealing two cards to the player comprising a player's hand and two cards to the dealer comprising a dealer's hand;

c) if the player's hand includes one Joker, the value of the player's hand is determined to be a numerical count of twenty-one;

d) if the player's hand includes two Jokers, the value of the player's hand is determined to be a blackjack;

e) if the dealer's hand includes one Joker, the value of the dealer's hand is determined to be a numerical count of twenty-one;

f) if the dealer's hand includes two Jokers, the value of the dealer's hand is determined to be a blackjack;

g) if neither the player's hand nor the dealer's hand includes a Joker, continuing the play according to the conventional manner of play of Twenty-One;

h) if at any time during the play of the hand either the player or the dealer receives a Joker, the Joker is given the numerical value of ten;

i) the player standing or receiving additional cards from the dealer as the player desires in accordance with the conventional manner of play of Twenty-One;

j) the dealer standing or receiving additional cards in accordance with the conventional manner of play of Twenty-One;

k) comparing the dealer's hand to the player's hand in accordance with the conventional manner of play of Twenty-One; and l) paying the player based on the amount of the player's wager if the player's hand beats the dealer's hand in accordance with the conventional manner of play of Twenty-One.

23. The method of claim 22 in which multiple decks of playing cards are used and one Joker is provided for each deck of playing cards.

24. A method of playing a modified version of Twenty-One wherein a standard fifty-two card deck of playing cards is modified by the addition of one or more Jokers comprising:

a) a player making a wager to be eligible to receive a hand of cards;

b) a dealer dealing two cards to the player comprising a player's hand and two cards to the dealer comprising a dealer's hand;

c) if the player's hand includes one Joker, the value of the player's hand is determined to be a numerical count of twenty-one;

d) if the player's hand includes two Jokers, the value of the player's hand is determined to be a blackjack;

e) if the dealer's hand includes one Joker, the value of the dealer's hand is determined to be a numerical count of twenty-one;

f) if the dealer's hand includes two Jokers, the value of the dealer's hand is determined to be a blackjack;

g) if neither the player's hand nor the dealer's hand includes a Joker, continuing the play according to the conventional manner of play of Twenty-One;

h) if at any time during the play of the hand either the player or the dealer receives a Joker, the Joker is given the numerical value that an Ace would have in the conventional manner of play of Twenty-One;

i) the player standing or receiving additional cards from the dealer as the player desires in accordance with the conventional manner of play of Twenty-One;

j) the dealer standing or receiving additional cards in accordance with the conventional manner of play of Twenty-One;

k) comparing the dealer's hand to the player's hand in accordance with the conventional manner of play of Twenty-One; and l) paying the player based on the amount of the player's wager if the player's hand beats the dealer's hand in accordance with the conventional manner of play of Twenty-One.

25. The method of claim 24 in which multiple decks of playing cards are used and one Joker is provided for each deck of playing cards.

26. The method of claim 24 in which multiple decks of playing cards are used and at least one Joker is provided.

27. The method of claim 24 further including:

a) a player making a second wager to be eligible for a separate payout;

b) tracking the number of consecutive hands that a player has won;

c) paying the player a predetermined amount if the player wins a pre-established number of hands in a row.

28. The method of claim 27 in which the predetermined amount is a multiple of the amount of the player's second wager.

29. The method of claim 27 in which the predetermined amount increases as the pre-established number of hands in a row increases.

* * * * *